US005865237A

United States Patent [19]

Schörghuber et al.

[11] Patent Number: 5,865,237

[45] Date of Patent: Feb. 2, 1999

[54] METHOD OF PRODUCING MOLDED BODIES OF A METAL FOAM

[75] Inventors: Franz Schörghuber, Altmünster, Austria; Frantisek Simancik, Bratislava, Slovakia; Erich Hartl, Altmünster, Austria

[73] Assignee: Leichtmetallguss-Kokillenbau-Werk Illichmann GmbH, Altmunster, Austria

[21] Appl. No.: 844,227

[22] Filed: Apr. 18, 1997

[30] Foreign Application Priority Data

Apr. 19, 1996 [AT] Austria ..... A 719/96

[51] Int. Cl.[6] ..... B22D 27/00

[52] U.S. Cl. ..... 164/79; 75/415

[58] Field of Search ..... 164/79; 75/415

[56] References Cited

U.S. PATENT DOCUMENTS 3,087,807 4/1963 Alien et al. .

FOREIGN PATENT DOCUMENTS 0 460 392 A1 12/1991 European Pat. Off. .

1 164 102 3/1957 Germany .

1 164 102 2/1964 Germany .

40 18 360 C1 6/1990 Germany .

40 18 360 5/1991 Germany .

43 26 982 C1 8/1993 Germany .

44 24 157 2/1995 Germany .

44 24 157 A1 2/1995 Germany .

43 40 791 5/1995 Germany .

43 40 791 A1 5/1995 Germany .

94/09931 5/1994 WIPO .

WO 94/09931 5/1994 WIPO .

*Primary Examiner*—Kuang Y. Lin

*Attorney, Agent, or Firm*—Herbert Dubno

[57] ABSTRACT

A method of making castings of metal foam in which compacts of the metal, e.g. aluminum, and a gas-producing foaming agent are heated in a chamber from which the foaming mass is driven completely into the mold cavity so that some residual foaming can complete the distribution of the foam in the mold cavity. The volume of the compacts is selected such that upon complete foaming, it will fill the mold cavity.

19 Claims, 5 Drawing Sheets

METHOD OF PRODUCING MOLDED BODIES OF A METAL FOAM

FIELD OF THE INVENTION

Our present invention relates to a method of making molded bodies from a metal foam, especially an aluminum foam which can be foamed powder metallurgically by, for example, the foaming of a compact or blank composed of metal powder and a gas-evolving foaming agent. More particularly, the invention relates to the production of shaped bodies in a mold from a foam produced by heating blanks or compacts, like wires, rods, tubes or granulates of a foamable metal like aluminum in a powder form together with an expanding agent releasing gas upon heating. The invention also relates to an apparatus for carrying out the method.

BACKGROUND OF THE INVENTION

Light-metal molded bodies can be produced as solid bodies, as hollow bodies and as metal-foam bodies. In the first case, the molten metal can be cast in a mold and is intended as much as possible to have a uniform structure. In the casting of hollow bodies, frequently expensive cores are required and efforts are made to provide a uniform and relatively thin wall structure. An alternative to the casting of hollow bodies and solid bodies is the formation of bodies from metal foam, i.e. the metal foam casting process.

In the casting of metal foams, the skin of the casting should have a smooth outer surface while the interior structure is porous. For many purposes a metal foam casting is ideal since it is especially light weight, can provide sound damping and has a reduced thermal conductivity. It is surprising that in spite of the high porosity, metal foam castings can have high strength. However not every kind of machine part can be fabricated by foam casting.

Two basically different processes for the formation of metal foam can be distinguished, namely, one using melt metallurgical techniques and the other utilizing power metallurgy. In DE 43 26 982 C1, a typical process and apparatus for carrying out the melt metallurgical process in the production of cast bodies from metal foam have been described. A melt, for example, an aluminum melt, is held in a liquid state in two communicating vessels, one of which is provided with an agitator which generates a foam from the metal melt. The completed foam can then be forced upwardly into the mold cavity by raising the level of the liquid aluminum upon which the foam floats.

A powder metallurgical metal foam can be produced as described in DE 41 01 630 C2 from a metal powder and a foaming agent which releases gas upon heating. A mixture of the foaming agent and metal powder can be hot compacted and shaped to a blank or compact of metal particles which are held firmly together to provide a matrix in which the expanding agent particles are held in a gas-tight manner. The blanks or compacts are introduced into a heated steel mold and are foamed by heating, with the metal foam expanding to fill the mold cavity. The drawback of this system is that the contour of the blank or of the compacts must correspond to the contour of the mold cavity. Otherwise uniform foaming does not occur and frequently not all of the interstices or corners of the mold will be filled. If the blank or compact is rod or bar-shaped, it must be cut to precise lengths and positioned precisely in the mold cavity. Cold-welded locations can develop between the foaming bars which can interfere with the homogeneous distribution of the metal foam within the mold cavity.

A collapsing of pores of a foam generated by the melt metallurgical technique can be observed when the foam is pressed in the mold as is often required. Furthermore, when heated molds are used, the temperature cannot be too high or else the metal foam again will tend to collapse. In many cases, the foaming takes place in an uncontrollable manner and pores of different sizes are produced. The problem is magnified when complex shapes must be produced and thus this type of foam casting can only be used effectively for objects of simple shapes. In the melt metallurgical process, moreover, an agitator is required and positioning of the agitator frequently poses a problem since the foam is only produced in the region of the agitator and previously produced foam may tend to collapse during the agitation process. The quantity of foam produced by the agitator cannot be accurately determined so that the reproducibility of the casting process is limited. The pores of the foam generated by an agitation process do not contain gas at a superatmospheric pressure which can resist collapse and in many cases, the resulting product is inhomogeneous and nonuniform.

OBJECTS OF THE INVENTION

It is, therefore, an important object of the present invention to produce complex three-dimensional molded bodies of high quality, uniformity and reproducibility.

Another object is to provide an important method of producing such high quality three-dimensional objects by foam casting whereby the drawbacks of earlier systems can be obviated.

It is also an object to provide a method of foam casting objects with uniform pore structures and unitary homogeneous surfaces while being able to reproducibly control pore size and pore density, layer thickness, surface properties and other desirable parameters during the fabrication.

Yet another object of the invention is to provide an improved apparats for foam casting.

SUMMARY OF THE INVENTION

These objects and others which will become apparent hereinafter are attained, in accordance with the present invention in a powder metallurgical approach in which the powder metallurgical starting material, namely the compacts described above, are foamed in a heatable chamber outside the casting mold. According to a feature of the invention, the volume of the powder metallurgical starting material, especially the blanks or compacts introduced into the heatable chamber, is sufficient such that, when fully foamed, the foamed metal will completely fill the casting mold. According to another feature of the invention, the total content of the chamber as far as the metal foam is concerned, is pressed into the mold cavity and preferably a part of the foaming of this material continues in a mold cavity until the latter is completely filled with the foamed metal.

More particularly, the method of the present invention can comprise the steps of:

(a) providing compacts of a powder of a metal to be foamed and a gas-evolving foaming agent;

(b) heating a volume of the compacts in a heatable chamber communicating with a mold having a mold cavity of a shape complementary to the casting to be made which, upon complete foaming, corresponds at least to the volume of the mold cavity, the heating of the compacts being sufficient to at least partially foam the metal of the powder;

(c) while the metal of the powder is being foamed in the chamber, forcing the entire contents of the chamber, formed by foaming of the compacts, into the mold cavity; and (d) permitting residual foaming of the contents in the cavity to distribute the foaming metal to all parts of the cavity and produce a foamed metal body conforming completely to the cavity.

By contrast with the conventional powder metallurgical process in which the metal foam is formed within the casting mold, with the invention the metal foam is formed predominantly externally of the casting mold by thermal foaming of the predetermined amount of the blank or compacts in the heatable chamber. This metal foam can then be pressed into the mold cavity during its formation by contrast to the process using melt metallurgical techniques. The final phase of the foam formation then occurs within the mold cavity.

As a result, remote regions of the mold cavity, difficult to fill contours or undercuts of the mold cavity and the like can thus be filled with the foaming material. A premature collapse of the pores is avoided.

A feature of the invention is that the density of the molded body can be adjustable by control of the degree of filling of the chamber, which can be heated by gas, with the blanks or starting material or by variation of the chamber volume. The point in time at which the metal foam is transferred from the chamber into the mold cavity is another criterion for the density of the foamed body which is produced. The latter criterion allows preselection of the residual foaming which is effected within the mold cavity.

With simple molds, foam formation in the mold cavity can be largely omitted. It is advantageous in accordance with a further feature of the invention to rotate the chamber containing the foaming starting material relative to or with the casting mold like a kind of rotary furnace and, optionally to tilt the chamber to empty the latter into the mold cavity. In this latter case, the mold cavity is filled with the intrinsic pressure of the foamed material, i.e. by gravity.

It has been found to be especially advantageous when the metal foam is forced by a piston into the mold cavity, preferably through a nozzle orifice. The piston speed of the piston generated pressure form further criteria for the structure of the finished object and its surface characteristics, pore shape and density.

The transfer of the metal foam which is produced can also be effected by displacing the metal foam using a metal foam repellent melt, i.e. a fused-salt melt on which the powder metallurgical metal foam floats and to which a pressure is applied, e.g. via a piston. The metal foam is lifted by this salt melt and forced into the mold cavity.

The metal foam may be lifted directly on the fused salt bath or a plate can float on the fused salt bath and can support the metal foam, this plate being interposed between the fused salt bath and the foam. According to another feature of the invention the melt carrying the metal foam should have a higher specific gravity than the mother metal of the foam and a lower melting point. The metal may be zinc, tin or aluminum. Where appropriate, the foam can float on a heavier metal.

By contrast with earlier metal foam casting processes, it has been found to be advantageous to feed the powder metallurgical metal foam into a nonmetallic mold cavity, the cavity of a sand mold.

The unheated sand mold has the advantage over a steel mold that it does not take up the heat of the metal foam as rapidly so that the foam phases remains until the foamed metal has completely filled the mold. Residual foam formation in the mold cavity is thus supported by the fact that heat is abstracted from the metal foam more slowly by the nonmetallic wall. The foam passes into the mold cavity while still in an active phase, leading to significant improvement.

To ensure a uniform pore or cell structure of the powder metallurgical metal foam, a uniform heating of the powder metallurgical starting material, i.e. the blank or compacts is required. Large temperature gradients should be avoided in the chamber and the foam formation should be effected by rapid heating of the chamber, especially at the edges thereof as well as in the interior, as uniformly as possible. This can be achieved by providing a tubular blank in the chamber with the smallest possible play from the inner wall of the chamber which is subject to heating along its exterior. The heating can be electrical, for example, inductive. Eddy currents and skin effects of the inductive heating are taken into consideration. The inductive heating, in combination with a tubular semiconductor gives rise to an improved foam quality. An automatic transfer of the foam from the chamber into the mold cavity is achieved at the right point in time by pressing the tubular blank at least at the final phase of the heating process by a piston with a defined and adjustable force against a nozzle plate so that the injection of the material of the compact into the mold is effected as soon as the blank reaches its melting point and is thereupon foamed.

For reduction of oxide coatings it is advantageous when the heating or a preheating of the blank is effected under a protective gas and particularly when the chamber is flushed with protective gas.

The mass in the chamber generates the metal foam and is limited in quantity to the requisite volume to fill the mold cavity.

To also fabricate large and spatially involved molded bodies, it has been found to be advantageous to supply the powder metallurgical foam from a plurality of chambers which can be connected in parallel, the chambers being discharged simultaneously or sequentially, one after another over a plurality of flow cross sections into the cavity of one or more molds.

A series of casting modules can thus be combined in a single apparatus for filling the cavities for a multiplicity of objects or for a single object. The modules are generally synchronously controlled, for example, for simultaneously fitting a mold.

Depending upon the mold cavity, it can also be advantageous to control the individual modules with a time staggering to thereby vary the density characteristic of the foamed body.

An apparatus for carrying out the process can have the chamber jacketed by a melt which is repellent to the metal foam and surrounds the chamber to heat it. The melt used can be heated in a separate furnace. In this manner the chamber for the powder metallurgical blank or compact can be subject to a rapid heat transfer to the compacts for foaming thereof. The apparatus can be automated in that one or more chambers can be arranged on a slide or carousel and the chambers can be shifted between loading or cleaning positions into a heating position in which the contents of the chambers can be discharged into the mold cavity.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
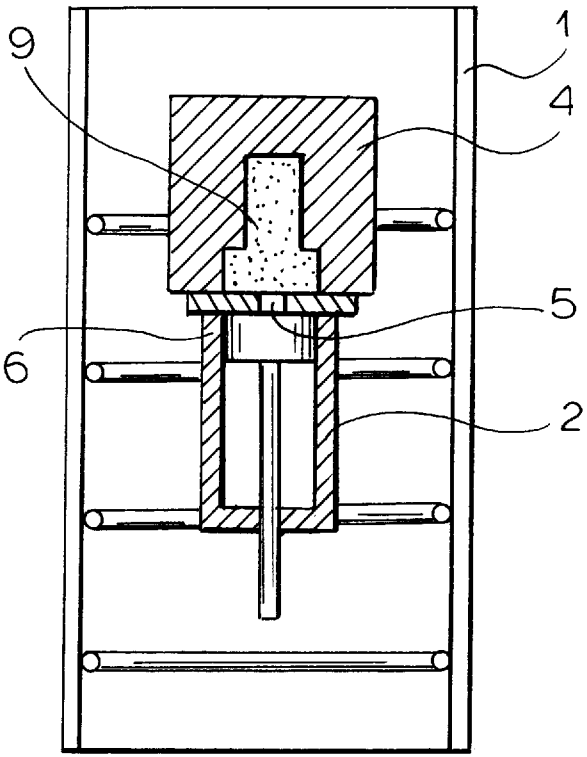
FIG. 2 is a view similar to FIG. 1 showing the apparatus after transfer of the metal foam to the casting mold.

In a furnace 1 or some other heating unit which can be gas-fired or can be an inductively heating furnace, there is provided a chamber 2 for receiving a powder metallurgical starting material 3. The latter is in a form of compacts, especially shaped blanks, which can be pieces of wire, pieces of tubing, a single tubular blank or the like formed by powder metallurgical techniques (i.e. the application of pressure) from the metal powder gas-producing expanding agent which, when the compact is heated, will allow melting of the metal powder and the foaming thereof to produce the metal foam. The casting mold 4 is connected with the chamber 2 via a nozzle 5 in a disk closing the chamber 2 and forming a perforated diaphragm through which the foaming metal is forced. A piston 6 is displaceable in the chamber 2 for that purpose.

The blank or compact can be, for example, formed from aluminum powder as described in EP 460 392 and can produce an aluminum foam. For that purpose the temperature generated by the furnace in the chamber 2 must reach 500° to 600° C., whereupon the piston 6 will completely and without residue transfer the contents of the chamber 2 into the mold cavity 4. The chamber 2 is thereby emptied and can be refilled with the starting material for the foaming process, the volume of the material introduced into the chamber 2 for each cycle being precisely determined by the expanded volume of that material to match the volume of the mold cavity.

The foam formation determines the point in time at which transfer of the contents from the chamber 2 to the mold 4 occurs. That point in time should be a point subsequent to the initial generation of the foam and, usually, prior to the termination of foam generation at a time such that within the mold cavity any residual foaming will result in the expansion of the foamed metal to fill interstices, undercuts and remote regions of the mold cavity. This point in time of transfer of the foam, together with the volume of the compacts, the consistency of the compacts and the foam and the temperature course during foam formation and cooling are important controllable parameters for the structure of the foamed body which is produced.

As soon as the foaming capacity has terminated and all of the foam is in the mold cavity, the mold can be removed from the furnace for cooling outside the furnace. The collapse of the foam pores because of the maintenance of the mold at a high temperature for an excessive period of time is thereby precluded. The cast body 9 can be removed from the mold and the mold and the chamber 2 return to the furnace after refilling of the chamber 2. The mold can be a steel mold which can be reused after cleaning or can be replaced by another mold.

Figure 4:
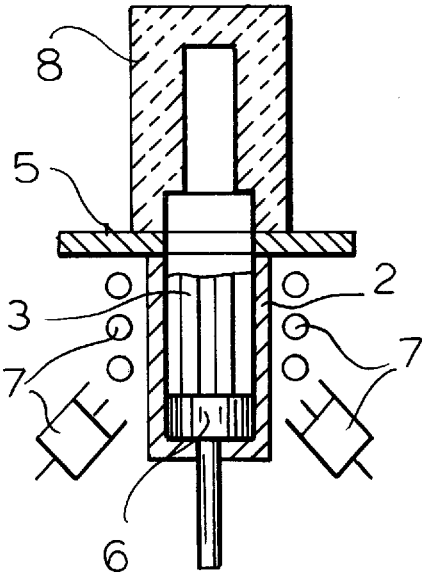
FIG. 4 is a cross sectional view through a further alternative.

Reference may be made to FIG. 4 in which the chamber 2 is provided with an inductive heater 7 in the form of a coil directly surrounding that chamber. A furnace 1 fully encompassing the mold and the chamber 2 is not required. The mold 8 here is unheated and is preferably a sand mold.

Figure 1:
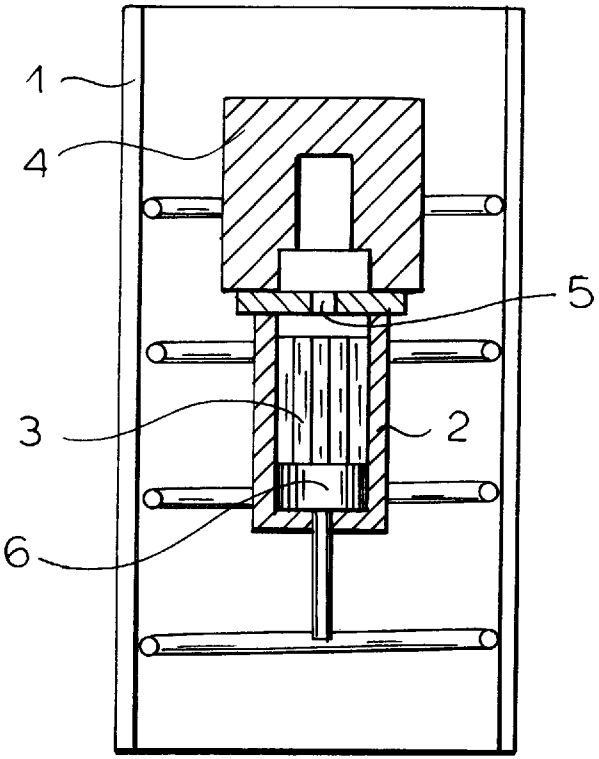
FIG. 1 is a diagrammatic cross section showing a furnace with a chamber and casting mold according to the invention prior to the commencement of foaming.

Foam formation in FIG. 4 is analogous to that of FIG. 1 in the chamber 2 and the foam is forced by the piston 6 into the sand mold 8. There is a minimum of heat abstraction from the metal foam by the wall of the mold since the latter is composed of sand. As a result, the metal foam retains its viscosity until it reaches the last corner of the mold cavity. Residual foaming within the mold cavity reinforces this effect.

In this manner, complex cast bodies can be made with small ribs, undercuts or the like. Steel molds, in the case of complex configurations of the mold cavity, have a tendency to suddenly abstract heat from the foam to reduce the flowability thereof and create impediments in the distribution of the foam in the mold cavity. As a consequence, steel molds usually must be additionally heated at critical regions. Internal stresses, locally different pore structures and even collapse of pores may occur because of the nonuniform temperatures. The sand mold 8 solves this problem and represents any nonmetallic mold, which can also be composed of ceramic or plaster with the same advantages.

Figure 3:
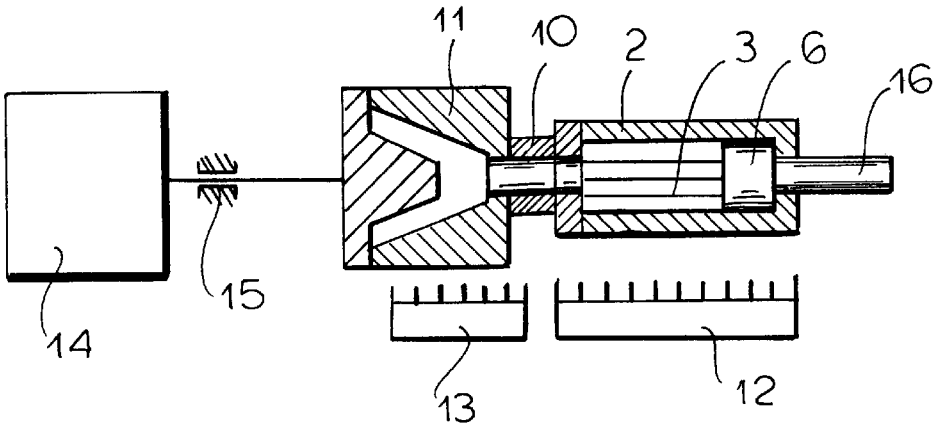
FIG. 3 is a cross sectional view representing an alternative apparatus for carrying out the method of the invention.

FIG. 3 shows an alternative to FIGS. 1 and 2. Practically the entire apparatus comprised of the chamber 2, the nozzle member 10 and the casting mold 11 is rotatable relative to one or more heating units 12, 13 which can be provided to heat the chamber 2 and the mold 11 and which can be separately regulatable and independently turned on or off. In the embodiment of FIG. 3 they may be gas burners.

For rotating these members, a drive 14 with a bearing can be provided, the piston rod 16 serving as the journal on the opposite side.

The process is carried out as in FIGS. 1 and 2. The rotation homogenizes the powder metallurgical foam in the chamber 2 and in the casting mold 11. When the latter is a nonmetallic mold as has been described with respect to FIG. 4, it can remain unheated and, if desired, only the chamber 2 or only the mold 11 can be rotated.

Figure 5:
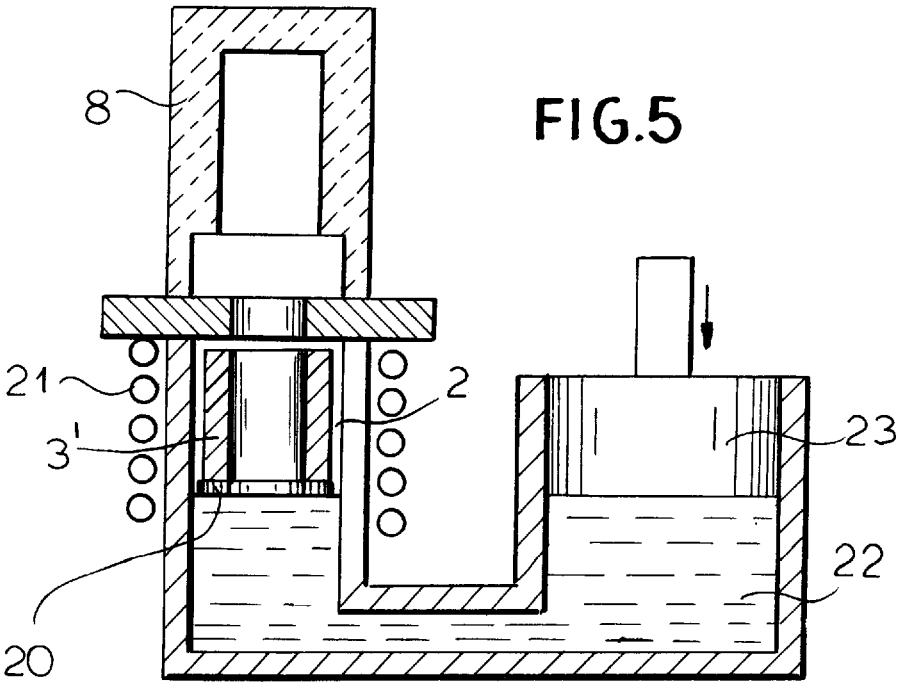
FIG. 5 is a cross sectional view of a system utilizing a melt to support the metal foam.

FIG. 5 shows an embodiment of the invention illustrated in principle in FIG. 4 wherein within the chamber 2 as the powder metallurgical compact, a tubular blank 3' is provided, this blank can be separated by a disk 20 of, for example, titanium or a ceramic, from a melt 22 interposed between the piston 23 and the chamber 2.

The tubular blank 3' is heated uniformly by an inductive heating coil 21 so that the foam formation is extremely uniform and homogeneous. The foam then floats on the "liquid piston" 22 which can be a zinc 10 or lead melt. The heating for maintaining the bath 22 at or above the melting point has not been shown.

When the piston 23 is forced downwardly, the disk 20 and the foam on it are raised until the entire body of foam is forced into the mold 8. The point in time of this transfer again is shortly before foaming is complete so that residual foaming in the mold cavity can occur. For reduction of oxide formation, a high heating speed of the blank is used. The liquid piston rising in the chamber 2 ensures removal of any oxide residues on the walls of the chamber 2 and limits their formation.

Figure 6:
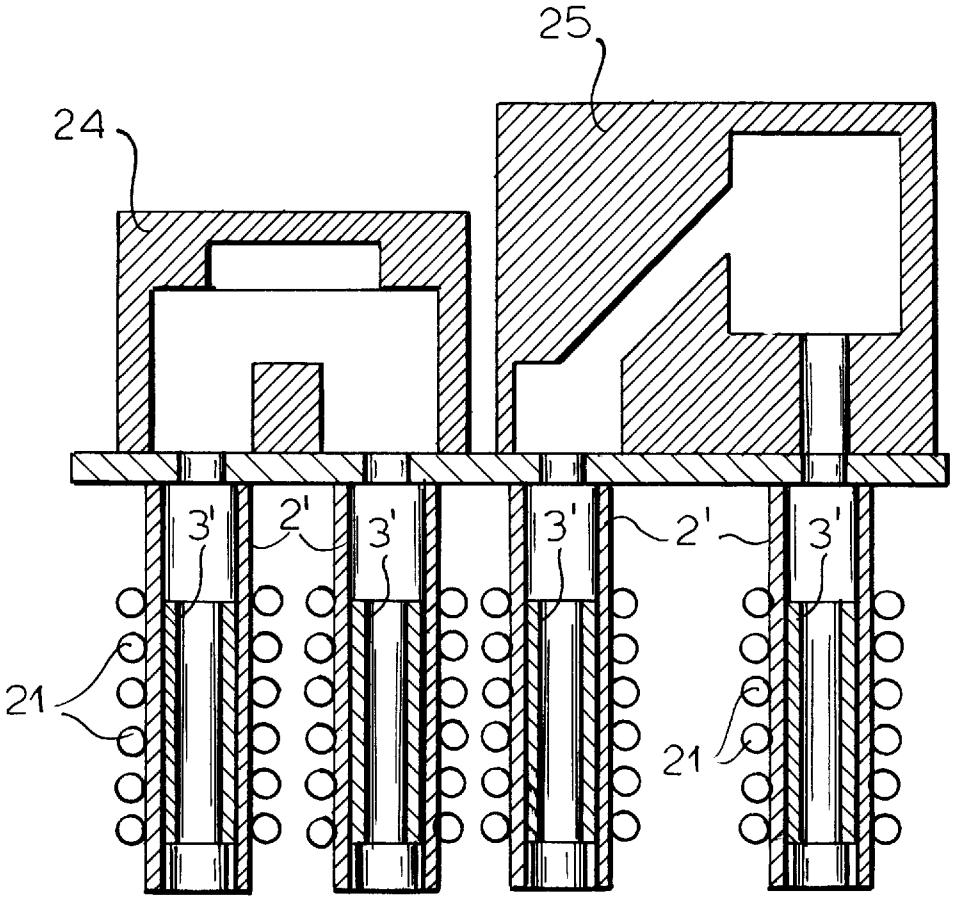
FIG. 6 is a cross sectional view through a rotatable mold and chamber system according to the invention.

FIG. 6 shows a multiplicity of heating chamber modules at 2' each filled with the powder metallurgical compacts or blanks and having an individual inductive heater 21. This arrangement provides a modular system whereby the chambers can be used with individual molds or with molds 24, 25 of greater volume, each of which can communicate with two or more heating chambers 2'. The heating chambers 2' are provided with respective pistons and can discharge into the respective molds at the same time or a time-spaced relationship or sequence.

Figure 7:
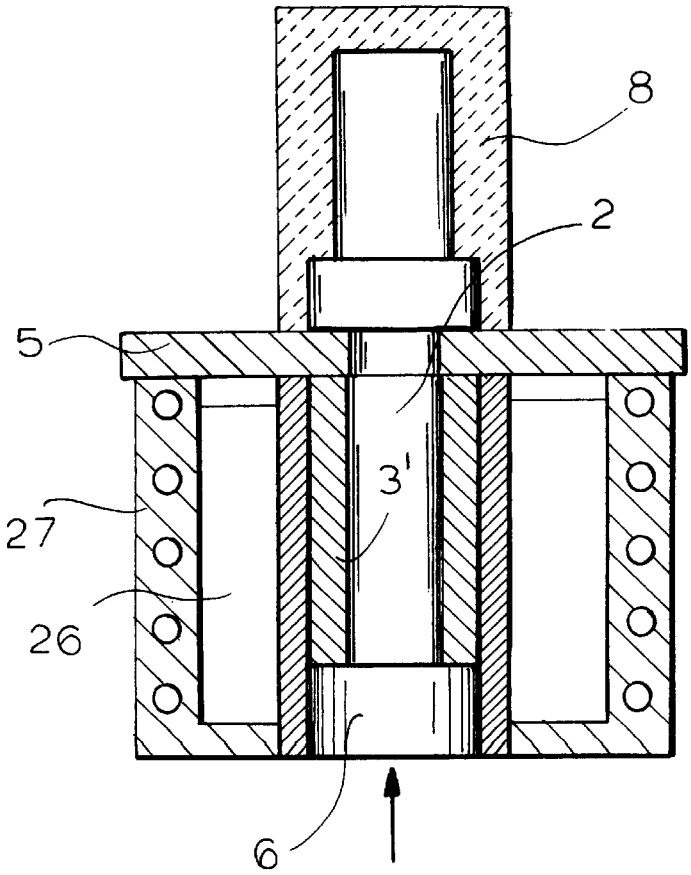
FIG. 7 is a cross sectional view showing another heating system for the chamber.

FIG. 7 shows that the chamber 2 can be a thermally-conductive wall in which the blank 3' closely fits with a minimum of play. The chamber 2 is surrounded by a metal foam repellent melt 26 heating the blank 3' through the chamber wall and heated in turn by a furnace 27 which may be of the inductive type. This system allows highly accurate control of the heating of the blank and also is capable of particularly rapidly heating the blank for uniformity of foaming formation. Any air gap between the blank 3' and the wall of the mold 2, which may form an insulator, is avoided. A liquid piston as in FIG. 5 can also be used.

According to the invention, the piston can press the blank 3' with a defined force against the orifice plate so that, as soon as the blank reaches the melting point of the metal powder and foaming begins, loss in integrity of the blank can enable the blank material and foam to be forced into the mold. The force on the piston and the rate of displacement of the foam into the mold can also be varied as soon as the piston 6 begins to move. This arrangement allows the apparatus to be controlled in a particularly simple manner to ensure that, with the other controlled parameters described, that the foam formation is uniform. Control of the system of the invention has been found to be far simpler than with earlier systems.

Figure 8:
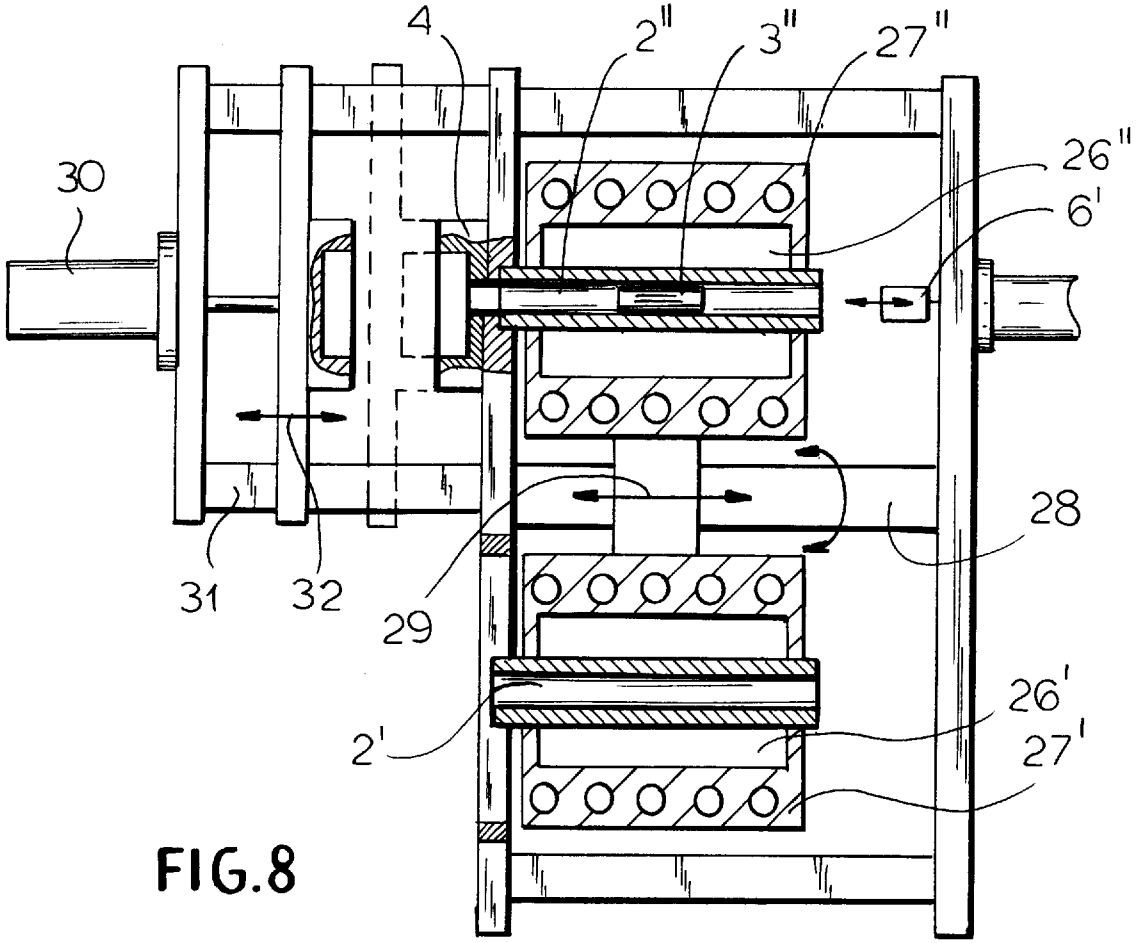
FIG. 8 is an elevational view partly broken away, showing an embodiment of the apparatus of the invention as shiftable chambers.

FIG. 8 shows another arrangement utilizing multiple chambers 2, 2" which can be provided with electrical heating units 27' and 27" with respective heat transfer melts 26', 26" utilizing the principles of FIG. 7.

The chambers 2', 2", etc. are displaceable utilizing the principles of a turret, on the shaft 28 between cleaning and filling stations and a station for heating and injection of the metal foam into the mold 4. A piston 6' based at this latter station, forces the foam into the mold. A horizontal arrangement of the chambers 2', 2" is here advantageous and the turret can be shifted linearly as represented by the arrow 29 as well for alignment with the mold.

The mold 4 is displaceable between closed and open positions by an operator 30 and the frame 31 as represented by the double-headed arrow 32. The piston 6' thus need not be subjected to heating until the compact is about to reach the melting point and thus thermal loading of the piston is minimized. Turntable or carousel structures as well as linearly-shiftable systems with multiple stations can of course also be used.

We claim:

1. A method of making a casting of a metal foam comprising the steps of:

(a) providing compacts of a powder of a metal to be foamed and a gas-evolving foaming agent;

(b) heating a volume of said compacts in a heatable chamber communicating with a mold having a mold cavity of a shape complementary to the casting to be made which, upon complete foaming, corresponds at least to the volume of said mold cavity, the heating of said compacts being sufficient to at least partially foam the metal of said powder;

(c) while said metal of said powder is being foamed in said chamber, forcing the entire contents of said chamber, formed by foaming of said compacts, into said mold cavity; and (d) permitting residual foaming of said contents in said cavity to distribute the foaming metal to all parts of said cavity and produce a foamed metal body conforming completely to said cavity.

2. The method defined in claim 1 wherein said compacts are composed of rods, wires, tubes or granulates of said metal powder and said foaming agent.

3. The method defined in claim 2 wherein the density of the body is controlled by adjusting a degree of filling of said chamber with said compacts.

4. The method defined in claim 2 wherein the density of the body is controlled by adjusting the volume of said chamber.

5. The method defined in claim 2 wherein said chamber is rotated during the heating thereof.

6. The method defined in claim 5 wherein said chamber is tilted to empty said chamber into said mold cavity.

7. The method defined in claim 2 wherein the contents of said chamber are discharged into said cavity by displacement of the contents of the chamber with a piston with preselection of the timing of the discharge of the chamber into the mold cavity and magnitude of residual foaming to yield a predetermined structure of said body.

8. The method defined in claim 2 wherein the contents of said chamber are discharged into said cavity by displacement of the contents of the chamber by a pressurized melt repellant to said foam and on which said foam floats.

9. The method defined in claim 8, further comprising providing an intermediate member between said melt and said foam.

10. The method defined in claim 2 wherein said mold cavity is provided from a nonmetallic material selected from the group which consists of a sand mold, a ceramic mold and a plaster mold.

11. The method defined in claim 2 wherein said contents of said chamber is forced into said mold cavity through a nozzle orifice between said chamber and said cavity.

12. The method defined in claim 2 wherein said compact is a tubular blank.

13. The method defined in claim 12 wherein said tubular blank is disposed in said chamber with minimum play with respect to a wall thereof and said blank is electrically heated through said wall inductively.

14. The method defined in claim 13 wherein said tubular blank is pressed by a piston against a plate provided with a nozzle orifice between said chamber and said cavity with a force sufficient to drive said contents into said cavity as soon as said blank reaches its melting point and is thereupon foamed.

15. The method defined in claim 14, further comprising the step of providing a protective gas blanket for said blank during heating thereof to reduce oxide layer formation.

16. The method defined in claim 14, further comprising the step of flushing said chamber with a protective gas to reduce oxide layer formation.

17. The method defined in claim 2 wherein a plurality of said chambers containing said compacts are heated and the contents thereof are displaced simultaneously into at least one of said mold cavities.

18. The method defined in claim 2 wherein a plurality of said chambers containing said compacts are heated and the contents thereof are displaced in a timed sequence into at least one of said mold cavities.

19. The method defined in claim 2 wherein a plurality of said chambers containing said compacts are heated and the contents thereof are displaced into a plurality of said mold cavities.

* * * * *